US011763969B2

(12) United States Patent
Yoshidome et al.

(10) Patent No.: US 11,763,969 B2
(45) Date of Patent: Sep. 19, 2023

(54) SOFT MAGNETIC METAL POWDER, DUST CORE, AND MAGNETIC COMPONENT

(71) Applicant: TDK CORPORATION, Tokyo (JP)

(72) Inventors: Kazuhiro Yoshidome, Tokyo (JP); Hiroyuki Matsumoto, Tokyo (JP); Kenji Horino, Tokyo (JP); Satoko Mori, Tokyo (JP); Takuma Nakano, Tokyo (JP); Seigo Tokoro, Tokyo (JP); Shota Otsuka, Tokyo (JP); Toru Ujiie, Tokyo (JP); Kentaro Mori, Tokyo (JP)

(73) Assignee: TDK CORPORATION, Tokyo (JP)

( * ) Notice: Subject to any disclaimer, the term of this patent is extended or adjusted under 35 U.S.C. 154(b) by 74 days.

(21) Appl. No.: 16/296,626

(22) Filed: Mar. 8, 2019

(65) Prior Publication Data

US 2019/0279802 A1 Sep. 12, 2019

(30) Foreign Application Priority Data

Mar. 9, 2018 (JP) ..... JP2018-043646

(51) Int. Cl.
*H01F 1/26* (2006.01)
*H01F 1/38* (2006.01)
(Continued)

(52) U.S. Cl.
CPC ..... *H01F 1/26* (2013.01); *B22F 1/16* (2022.01); *H01F 1/24* (2013.01); *H01F 1/33* (2013.01);
(Continued)

(58) Field of Classification Search
CPC .... B22F 1/02; B22F 2301/35; B22F 2304/10; H01F 1/15308; H01F 1/15333;
(Continued)

(56) References Cited

U.S. PATENT DOCUMENTS 9,180,517 B2 * 11/2015 Takahashi ..... H01F 1/33
2006/0216507 A1 * 9/2006 Toyoda ..... H01F 1/26 428/402
(Continued)

FOREIGN PATENT DOCUMENTS

CN 103748250 A 4/2014
CN 104028762 A 9/2014
(Continued)

OTHER PUBLICATIONS

Machine Translation for JP 2011032496 (Year: 2011).*
(Continued)

*Primary Examiner* — Mark Ruthkosky
*Assistant Examiner* — Rebecca L Grusby
(74) *Attorney, Agent, or Firm* — Oliff PLC

(57) ABSTRACT

A soft magnetic metal powder having soft magnetic metal particles including Fe, wherein a surface of the soft magnetic metal particle is covered by a coating part, the coating part has a first coating part and a second coating part in this order from the surface of the soft magnetic metal particle towards outside, the first coating part includes oxides of Fe as a main component, the second coating part includes a compound of at least one element selected from the group consisting of P, Si, Bi, and Zn, and a ratio of trivalent Fe atom among Fe atoms of oxides of Fe included in the first coating part is 50% or more.

9 Claims, 3 Drawing Sheets

(51) Int. Cl.

| | |
|---|---|
| ***H01F 1/33*** | (2006.01) |
| ***H01F 1/24*** | (2006.01) |
| ***H01F 3/08*** | (2006.01) |
| ***B22F 1/16*** | (2022.01) |
| ***H01F 27/255*** | (2006.01) |
| ***H01F 41/02*** | (2006.01) |
| ***H01F 1/153*** | (2006.01) |

(52) U.S. Cl.
CPC ..... *H01F 1/38* (2013.01); *H01F 3/08* (2013.01); *B22F 2301/35* (2013.01); *B22F 2304/10* (2013.01); *H01F 1/15308* (2013.01); *H01F 1/15333* (2013.01); *H01F 27/255* (2013.01); *H01F 41/0246* (2013.01)

(58) Field of Classification Search
CPC ..... H01F 1/24; H01F 1/26; H01F 1/33; H01F 1/38; H01F 27/255; H01F 3/08; H01F 41/0246; H01F 1/15383; H01F 1/15358; H01F 1/22; H01F 17/04; H01F 1/12; H01F 1/14; H01F 1/20
See application file for complete search history.

(56) References Cited

U.S. PATENT DOCUMENTS

| | | | | |
|---|---|---|---|---|
| 2007/0169851 | A1* | 7/2007 | Kugai | B22F 1/0088 148/306 |
| 2014/0104023 | A1 | 4/2014 | Yang et al. | |
| 2014/0191832 | A1 | 7/2014 | Ohta et al. | |
| 2014/0322065 | A1* | 10/2014 | Kim | H01F 1/24 75/232 |
| 2015/0021512 | A1* | 1/2015 | Takahashi | H01F 1/01 252/62.55 |
| 2016/0276074 | A1* | 9/2016 | Lee | H01F 1/24 |
| 2018/0374619 | A1* | 12/2018 | Orimo | B22F 1/16 |
| 2019/0103207 | A1* | 4/2019 | Sato | H01F 1/24 |
| 2019/0267170 | A1* | 8/2019 | Nakamura | B22F 1/16 |
| 2020/0203067 | A1* | 6/2020 | Sankarasubramanian | H01L 28/10 |

FOREIGN PATENT DOCUMENTS

| | | | | |
|---|---|---|---|---|
| CN | 104934180 | A | | 9/2015 |
| JP | 2003306704 | A | * | 10/2003 |
| JP | 2007-194273 | A | | 8/2007 |
| JP | 2007194273 | A | * | 8/2007 |
| JP | 2011-032496 | A | | 2/2011 |
| JP | 2011032496 | A | * | 2/2011 |
| JP | 2013168648 | A | * | 8/2013 |
| JP | 2015-132010 | A | | 7/2015 |
| JP | 2016021510 | A | * | 2/2016 |

OTHER PUBLICATIONS

Machine Translation for JP 2007194273 (Year: 2007).*
Machine Translation via EPO of JP 2013-168648 (Year: 2013).*
Machine Translation via EPO of JP 2003-306704 (Year: 2003).*
Machine Translation of JP 2015-132010 via EPO (Year: 2015).*
Machine Translation of JP 2007-254768 via EPO (Year: 2007).*
Machine translation of JP 2016-021510 via EPO (Year: 2016).*

* cited by examiner

SOFT MAGNETIC METAL POWDER, DUST CORE, AND MAGNETIC COMPONENT

BACKGROUND OF THE INVENTION

The present invention relates to soft magnetic metal powder, a dust core, and a magnetic component.

As a magnetic component used in power circuits of various electronic equipments, a transformer, a choke coil, an inductor, and the like are known.

Such magnetic component is configured so that a coil (winding coil) as an electrical conductor is disposed around or inside a core exhibiting predetermined magnetic properties.

As a magnetic material used to the core provided to the magnetic component such as an inductor and the like, a soft magnetic metal material including iron (Fe) may be mentioned as an example. The core can be obtained for example by compress molding the soft magnetic metal powder including particles constituted by a soft magnetic metal including Fe.

In such dust core, in order to improve the magnetic properties, a proportion (a filling ratio) of magnetic ingredients is increased. However, the soft magnetic metal has a low insulation property, thus in case the soft magnetic metal particles contact against each other, when voltage is applied to the magnetic component, a large loss is caused by current flowing between the particles in contact (inter-particle eddy current). As a result, a core loss of the dust core becomes large.

Thus, in order to suppress such eddy current, an insulation coating is formed on the surface of the soft magnetic metal particle. For example, Japanese Patent Application Laid-Open No. 2015-132010 discloses that powder glass including oxides of phosphorus (P) is softened by mechanical friction and adhered on the surface of Fe-based amorphous alloy powder to form an insulation coating layer.

[Patent Document 1] JP Patent Application Laid Open No. 2015-132010

BRIEF SUMMARY OF THE INVENTION

Patent Document 1 discloses a dust core which is formed by mixing and compress molding a resin and Fe-based amorphous alloy powder which is formed with an insulation coating layer. According to the present inventors, in case of heat treating the dust core of Patent Document 1, rapid decrease of a resistivity of the dust core was confirmed. That is, the dust core according to Patent Document 1 had a low heat resistance.

The present invention is attained in view of such circumstances, and the object is to provide a dust core having a good heat resistance, a magnetic component including the dust core, and a soft magnetic metal powder suitable for the dust core.

The present inventors have found that the reason for the dust core according to Patent Document 1 having a low heat resistance is because metal Fe included in Fe-based amorphous alloy powder flows into a glass component constituting the insulation coating layer and reacts with a component included in the glass component thus causing the heat resistance of the dust core to deteriorate. Based on this finding, the present inventors have found that the heat resistance of the dust core can be improved by forming a layer interfering a movement of Fe to the coating layer between the soft magnetic metal particle including Fe and the coating layer having an insulation property, thereby the present invention has been attained.

That is, the embodiment of the present invention is

[1] a soft magnetic metal powder having soft magnetic metal particles including Fe, wherein a surface of the soft magnetic metal particle is covered by a coating part, the coating part has a first coating part and a second coating part in this order from the surface of the soft magnetic metal particle towards outside, the first coating part includes oxides of Fe as a main component, the second coating part includes a compound of at least one element selected from the group consisting of P, Si, Bi, and Zn, and a ratio of trivalent Fe atom among Fe atoms of oxides of Fe included in the first coating part is 50% or more.

[2] The soft magnetic metal powder according to [1], wherein the oxides of Fe included in the first coating part is $Fe_2O_3$ and/or $Fe_3O_4$, and the first coating part includes oxides of at least one element selected from the group consisting of Cu, Si, Cr, B, Al, and Ni.

[3] The soft magnetic metal powder according to [1] or [2], wherein the second coating part includes the compound of at least one element selected from the group consisting of P, Si, Bi, and Zn as a main component.

[4] The soft magnetic metal powder according to any one of [1] to [3], wherein the soft magnetic metal particle includes a crystalline region, and an average crystallite size is 1 nm or more and 50 nm or less.

[5] The soft magnetic metal powder according to any one of [1] to [3], wherein the soft magnetic metal particle is amorphous.

[6] A dust core constituting the soft magnetic metal powder according to any one of [1] to [5].

[7] A magnetic component comprising the dust core according to [6].

According to the present invention, the dust core having a good heat resistance, the magnetic component including the dust core, and the soft magnetic metal powder suitable for the dust core can be provided.

DETAILED DESCRIPTION OF THE INVENTION

Hereinafter, the present invention is described in detail in the following order based on specific examples shown in figures.

1. Soft Magnetic Metal Powder
   1.1 Soft Magnetic Metal Particle
   1.2 Coating part
   1.2.1 First Coating Part
   1.2.2. Second Coating Part 2. Dust Core
3. Magnetic Component
4. Method of Producing Dust Core
4.1 Method of Producing Soft Magnetic Metal Powder
4.2 Method of Producing Dust Core (1. Soft Magnetic Metal Powder)

Figure 1:
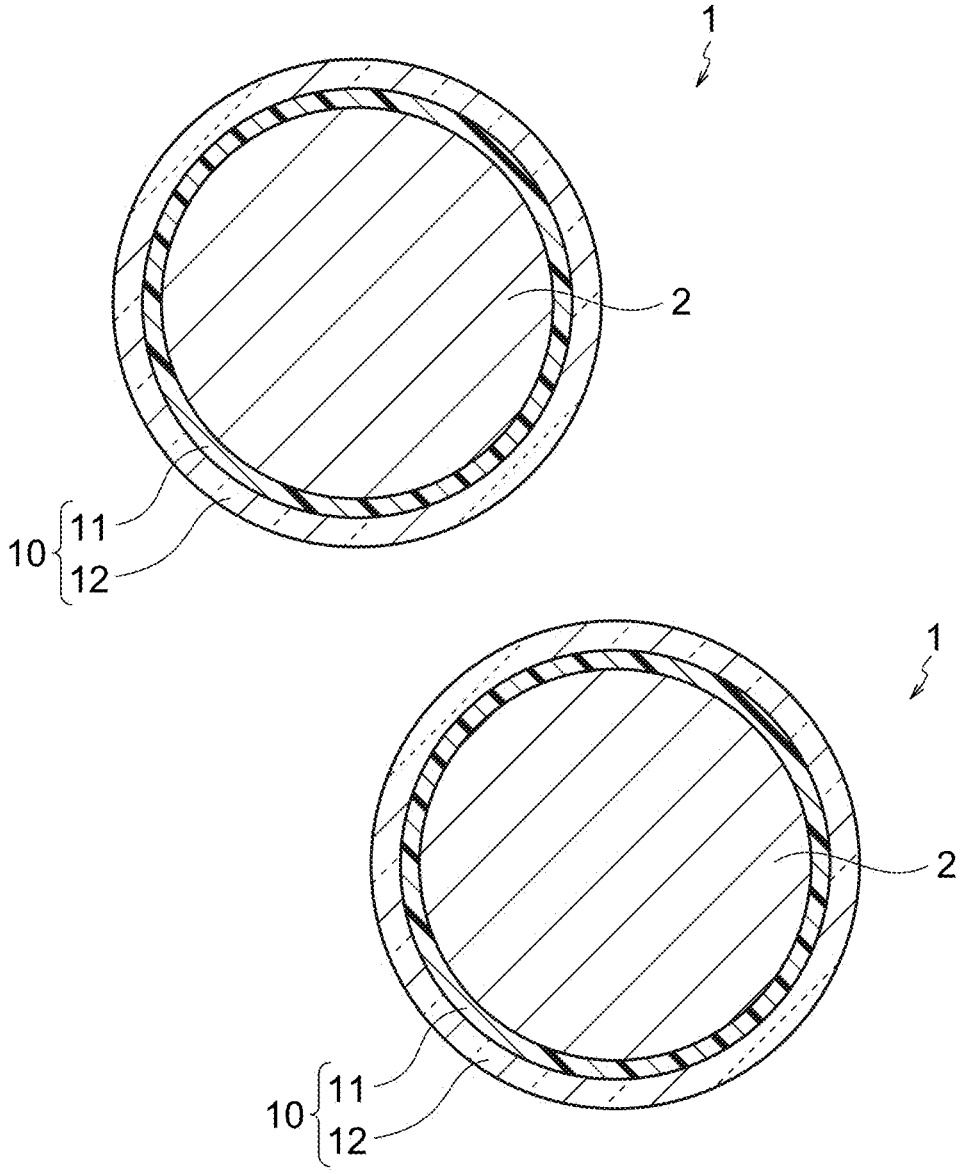
FIG. 1 is a schematic image of a cross section of a coated particle constituting soft magnetic metal powder according to the present embodiment.

As shown in FIG. 1, the soft magnetic metal powder according to the present embodiment includes coated particles 1 of which a coating part 10 is formed to a surface of a soft magnetic metal particle 2. When a number ratio of the particle included in the soft magnetic metal powder is 100%, a number ratio of the coated particle is preferably 90% or more, and more preferably 95% or more. Note that, shape of the soft magnetic metal particle 2 is not particularly limited, and it is usually spherical.

Also, an average particle size (D50) of the soft magnetic metal powder according to the present embodiment may be selected depending on purpose of use and material. In the present embodiment, the average particle size (D50) is preferably within the range of 0.3 to 100 μm. By setting the average particle size of the soft magnetic metal powder within the above mentioned range, sufficient moldability and predetermined magnetic properties can be easily maintained. A method of measuring the average particle size is not particularly limited, and preferably a laser diffraction scattering method is used.

(1.1 Soft Magnetic Metal Particle)

In the present embodiment, a material of the soft magnetic metal particle is not particularly limited as long as the material includes Fe and has soft magnetic property. Effects of the soft magnetic metal powder according to the present embodiment are mainly due to the coating part which is described in below, and the material of the soft magnetic metal particle has only little contribution.

As the material including Fe and having soft magnetic property, pure iron, Fe-based alloy, Fe—Si-based alloy, Fe—Al-based alloy, Fe—Ni-based alloy, Fe—Si—Al-based alloy, Fe—Si—Cr-based alloy, Fe—Ni—Si—Co-based alloy, Fe-based amorphous alloy, Fe-based nanocrystal alloy, and the like may be mentioned.

Fe-based amorphous alloy has random alignment of atoms constituting the alloy, and it is an amorphous alloy which has no crystallinity as a whole. As Fe-based amorphous alloy, for example, Fe—Si—B-based alloy, Fe—Si—B—Cr—C-based alloy, and the like may be mentioned.

Fe-based nanocrystal alloy is an alloy of which a microcrystal of a nanometer order is deposited in an amorphous by heat treating Fe-based alloy having a nanohetero structure in which an initial microcrystal exists in the amorphous.

In the present embodiment, the average crystallite size of the soft magnetic metal particle constituted by Fe-based nanocrystal alloy is preferably 1 nm or more and 50 nm or less, and more preferably 5 nm or more and 30 nm or less. By having the average crystallite size within the above range, even when stress is applied to the particle while forming the coating part to the soft magnetic metal particle, a coercivity can be suppressed from increasing.

As Fe-based nanocrystal alloy, for example, Fe—Nb—B-based alloy, Fe—Si—Nb—B—Cu-based alloy, Fe—Si—P—B—Cu-based alloy, and the like may be mentioned.

Also, in the present embodiment, the soft magnetic metal powder may include only the soft magnetic metal particles made of same material, and also the soft magnetic metal particles having different materials may be mixed. For example, the soft magnetic metal powder may be a mixture of a plurality of types of Fe-based alloy particles and a plurality of types of Fe—Si-based alloy particles.

Note that, as an example of a different material, in case of using different elements for constituting the metal or the alloy, in case of using same elements for constituting the metal or the alloy but having different compositions, in case of having different crystal structure, and the like may be mentioned.

(1.2 Coating Part)

The coating part 10 has an insulation property, and is constituted from a first coating part 11 and a second coating part 12. The coating part 10 may include other coating part besides the first coating part 11 and the second coating part 12 as long as the coating part 10 is constituted in an order of the first coating part 11 and the second coating part 12 from the surface of the soft magnetic metal particle towards outside.

The other coating part besides the first coating part 11 and the second coating part 12 may be placed between the surface of the soft magnetic metal particle and the first coating part 11, may be placed between the first coating art 11 and the second coating part 12, or may be placed on the second coating part 12.

In the present embodiment, the first coating part 11 is formed so as to cover the surface of the soft magnetic metal particle 2, and the second coating part 12 is formed so as to cover the surface of the first coating part 11.

In the present embodiment, by referring that the surface is covered by a substance, it means that the substance is in contact with the surface and the substance is fixed to cover the part which is in contact. Also, the coating part which covers the surface of the soft magnetic metal particle or the coating part only needs to cover at least part of the surface of the particle, and preferably the entire surface is covered. Further, the coating part may cover the surface continuously, or it may cover in discontinuous manner.

(1.2.1. First Coating Part)

As shown in FIG. 1, the first coating part 11 covers the surface of the soft magnetic metal particle 2. In the present embodiment, the first coating part 11 includes oxides of Fe as a main component. By referring "includes oxides of Fe as the main component", it means that when a total content of the elements excluding oxygen included in the first coating part 11 is 100 mass %, a content of Fe is the largest. Also, in the present embodiment, 50 mass % or more of Fe is preferably included with respect to a total content of 100 mass % of the elements excluding oxygen.

Oxides of Fe are not particularly limited, and may exist as $Fe_2O_3$ and $Fe_3O_4$ in the present embodiment. Note that, in the present embodiment, a ratio of trivalent Fe is 50% or more among Fe of Fe oxides included in the first coating part 11. Also, a ratio of trivalent Fe is more preferably 60% or more, and further preferably it is 70% or more.

As the coating part has the first coating part, the heat resistance property of the obtained dust core improves. Therefore, since a resistivity of the dust core after the heat treatment can be suppressed from decreasing, a core loss of the dust core can be reduced. Also, the withstand voltage property of the dust core improves as well. Therefore, a dielectric breakdown does not occur even when high voltage is applied to the dust core which is obtained by heat curing. As a result, a rated voltage of the dust core can be increased, and also a compact dust core can be attained.

Also, the first coating part may include other oxide component besides oxides of Fe. For example, as such oxide component, alloy element other than Fe included in the soft magnetic metal constituting the soft magnetic metal particle may be mentioned. Specifically, oxides of at least one element selected from the group consisting of Cu, Si, Cr, B, Al, and Ni may be mentioned. These oxides may be oxides formed to the soft magnetic metal particle, or it may be oxides of alloy element derived from alloy element included in the soft magnetic metal constituting the soft magnetic metal particle. By including oxides of these elements in the first coating part, the insulation property of the coating part can be enhanced. That is, by having the oxides of at least one element selected from the group consisting of Cu, Si, Cr, B, Al, and Ni in the first coating part as a mixture in addition to oxides of Fe, the insulation property of the coating part can be reinforced.

Among the elements of oxides included in the first coating part 11, when a total content of the elements excluding oxygen included in the first coating part 11 is 100 mass %, a total content of at least one element selected from the group consisting of Cu, Si, Cr, B, Al, and Ni is preferably 5 mass % or more, more preferably 10 mass % or more, and even more preferably 30 mass % or more.

Components included in the first coating part can be identified by information such as an element analysis of Energy Dispersive X-ray Spectroscopy (EDS) using Scanning Transmission Electron Microscope (STEM), an element analysis of Electron Energy Loss Spectroscopy (EELS), a lattice constant and the like obtained from Fast Fourier Transformation (FFT) analysis of TEM image, and the like.

A method of analyzing whether the ratio of trivalent Fe is 50% or more among Fe included in the first coating part 11 is not particularly limited as long as it is an analysis method capable of analyzing a chemical bonding state between Fe and O. However, in the present embodiment, the first coating part is subjected to an analysis using Electron Energy Loss Spectroscopy (EELS). Specifically, Energy Loss Near Edge Structure (ELNES) which appears in EELS spectrum obtained by TEM is analyzed to obtain information regarding the chemical bonding state between Fe and O, thereby valance of Fe is calculated.

In EELS spectrum of oxides of Fe, shape of ELNES spectrum at oxygen K-edge reflects the chemical bonding state between Fe and O, and changes depending on valance of Fe. Thus, for EELS spectrum of a standard substance of $Fe_2O_3$ of which valance of Fe is trivalent and EELS spectrum of a standard substance of FeO of which valance of Fe is divalent, ELNES spectrum of oxygen K-edge of each is taken as references. Here, regarding ELNES spectrum of oxygen K-edge of $Fe_3O_4$, divalent Fe and trivalent Fe both exist in $Fe_3O_4$, and the spectrum shape is about the same as a composite shape of ELNES spectrum shape of oxygen K-edge of FeO and ELNES spectrum shape of oxygen K-edge of $Fe_2O_3$, therefore ELNES spectrum of oxygen K-edge of $Fe_3O_4$ is not used as a reference.

Note that, form of oxides of Fe existing in the first coating part is determined depending on information such as element analysis by other methods, a lattice constant, and the like, thus even if the ELNES spectrum of oxygen K-edge of $Fe_3O_4$ is not used as the reference, this does not mean that $Fe_3O_4$ does not exist in the first coating part. As a method of verifying FeO, $Fe_2O_3$, and $Fe_3O_4$, for example, a method of analyzing a diffraction pattern obtained from electronic microscope observation may be mentioned.

In order to calculate valance of Fe, ELNES spectrum of oxygen K-edge of oxides of Fe included in the first coating part is fitted by a least square method using the reference spectrum. By standardizing the fitting result so that a sum of a fitting coefficient of FeO spectrum and a fitting coefficient of $Fe_2O_3$ is 1, a ratio derived from FeO spectrum and a ratio derived from $Fe_2O_3$ spectrum with respect to ELNES spectrum of oxygen K-edge of oxides of Fe included in the first coating part can be calculated.

In the present embodiment, the ratio derived from $Fe_2O_3$ spectrum is considered as the ratio of trivalent Fe in oxides of Fe included in the first coating part, thereby the ratio of trivalent Fe is calculated.

Note that, fitting using a least square method can be done using known software and the like.

The thickness of the first coating part 11 is not particularly limited, as long as the above mentioned effects can be obtained. In the present embodiment, it is preferably 3 nm or more and 50 nm or less. More preferably it is 5 nm or more, and even more preferably it is 10 nm or more. On the other hand, it is more preferably 50 nm or less, and even more preferably 20 nm or less.

In the present embodiment, oxides of Fe included in the first coating part 11 have a dense structure. As oxides of Fe have a dense structure, a dielectric breakdown less likely occurs in the coating part, and the withstand voltage is enhanced. Such oxides of Fe having a dense structure can be suitably formed by heat treating in oxidized atmosphere.

On the other hand, oxides of Fe may be formed as a natural oxide film by oxidizing the surface of the soft magnetic metal particle in air. At the surface of the soft magnetic metal particle, under the presence of water, $Fe^{2+}$ is generated by redox reaction, and $Fe^{3+}$ is generated by further oxidizing $Fe^{2+}$ in air. $Fe^{2+}$ and $Fe^{3+}$ coprecipitate and generate $Fe_3O_4$, and the generated $Fe_3O_4$ tends to easily fall off from the surface of the soft magnetic metal particle. Also, $Fe^{2+}$ and $Fe^{3+}$ may form hydrous iron oxides (iron hydroxide, iron oxyhydroxide, and the like) by hydrolysis, and may be included in the natural oxide film. However, the hydrous iron oxides does not form a dense structure, hence even if the natural oxide film which does not include oxides of Fe having a dense structure is formed as the first coating part, the withstand voltage cannot be improved.

(1.2.2. Second Coating Part)

As shown in FIG. 1, the second coating part 12 covers the surface of the first coating part 11. In the present embodiment, the second coating part 12 includes a compound of at least one element selected from the group consisting of P, Si, Bi, and Zn. Also, the compound is preferably oxides, and more preferably oxide glass.

Also, the compound of at least one element selected from the group consisting of P, Si, Bi, and Zn is preferably included as the main component. By referring "includes oxides of at least one element selected from the group consisting of P, Si, Bi, and Zn as the main component", this means that when a total content of the elements excluding oxygen included in the second coating part 12 is 100 mass %, a total content of at least one element selected from the group consisting of P, Si, Bi, and Zn is the largest. Also, in the present embodiment, the total content of these elements are preferably 50 mass % or more, and more preferably 60 mass % or more.

The oxide glass is not particularly limited, and for example phosphate ($P_2O_5$) based glass, bismuthate ($Bi_2O_3$) based glass, borosilicate ($B_2O_3$—$SiO_2$) based glass, and the like may be mentioned.

As $P_2O_5$-based glass, a glass including 50 wt % or more of $P_2O_5$ is preferable, and for example $P_2O_5$—ZnO—$R_2O$—$Al_2O_3$-based glass and the like may be mentioned. Note that, "R" represents an alkaline metal.

As $Bi_2O_3$-based glass, a glass including 50 wt % or more of $Bi_2O_3$ is preferable, and for example $Bi_2O_3$—ZnO—$B_2O_3$—$SiO_2$-based glass and the like may be mentioned.

As $B_2O_3$—$SiO_2$-based glass, a glass including 10 wt % or more of $B_2O_3$ and 10 wt % or more of $SiO_2$ is preferable, and for example BaO—ZnO—$B_2O_3$—$SiO_2$—$Al_2O_3$-based glass and the like may be mentioned.

As the coating part has the second coating part, the coated particle exhibits high insulation property, therefore the resistivity of the dust core constituted by the soft magnetic metal powder including the coated particle improves. Further, the first coating part is placed between the soft magnetic metal particle and the second coating part, thus even when the dust core is heat treated, the movement of Fe to the second coating part is interfered. As a result, the resistivity of the dust core can be suppressed from decreasing.

As similar to the components included in the first coating part, components included in the second coating part can be identified by information such as an element analysis of EDS using TEM, an element analysis of EELS, a lattice constant and the like obtained from FFT analysis of TEM image, and the like.

The thickness of the second coating part 12 is not particularly limited, as long as the above mentioned effects can be attained. In the present embodiment, the thickness is preferably 5 nm or more and 200 nm or less.

More preferably, it is 7 nm or more, and even more preferably it is 10 nm or more. On the other hand, it is more preferably 100 nm or less, and even more preferably 30 nm or less.

(2. Dust Core)

The dust core according to the present embodiment is constituted from the above mentioned soft magnetic metal powder, and it is not particularly limited as long as it is formed to have predetermined shape. In the present embodiment, the dust core includes the soft magnetic metal powder and a resin as a binder, and the soft magnetic metal powder is fixed to a predetermined shape by binding the soft magnetic metal particles constituting the soft magnetic metal powder with each other via the resin. Also, the dust core may be constituted from the mixed powder of the above mentioned soft magnetic metal powder and other magnetic powder, and may be formed into a predetermined shape.

(3. Magnetic Component)

The magnetic component according to the present embodiment is not particularly limited as long as it is provided with the above mentioned dust core. For example, it may be a magnetic component in which an air coil with a wire wound around is embedded inside the dust core having a predetermined shape, or it may be a magnetic component of which a wire is wound for a predetermined number of turns to a surface of the dust core having a predetermined shape. The magnetic component according to the present embodiment is suitable for a power inductor used for a power circuit.

(4. Method of Producing Dust Core)

Next, the method of producing the dust core included in the above mentioned magnetic component is described. First, the method of producing the soft magnetic metal powder constituting the dust core is described.

(4.1. Method of Producing Magnetic Metal Powder)

In the present embodiment, the soft magnetic metal powder before the coating part is formed can be obtained by a same method as a known method of producing the soft magnetic metal powder. Specifically, the soft magnetic metal powder can be produced using a gas atomization method, a water atomization method, a rotary disk method, and the like. Also, the soft magnetic metal powder can be produced by mechanically pulverizing a thin ribbon obtained by a single-roll method. Among these, from a point of easily obtaining the soft magnetic metal powder having desirable magnetic properties, a gas atomization method is preferably used.

In a gas atomization method, at first, a molten metal is obtained by melting the raw materials of the soft magnetic metal constituting the soft magnetic metal powder. The raw materials of each metal element (such as pure metal and the like) included in the soft magnetic metal is prepared, and these are weighed so that the composition of the soft magnetic metal obtained at end can be attained, and these raw materials are melted. Note that, the method of melting the raw materials of the metal elements is not particularly limited, and the method of melting by high frequency heating after vacuuming inside the chamber of an atomizing apparatus may be mentioned. The temperature during melting may be determined depending on the melting point of each metal element, and for example it can be 1200 to 1500° C.

The obtained molten metal is supplied into the chamber as continuous line of fluid through a nozzle provided to a bottom of a crucible, then high pressure gas is blown to the supplied molten metal to form droplets of molten metal and rapidly cooled, thereby fine powder was obtained. A gas blowing temperature, a pressure inside the chamber, and the like can be determined depending of the composition of the soft magnetic metal. Also, as for the particle size, it can be adjusted by a sieve classification, an air stream classification, and the like.

Next, the coating part is formed to the obtained soft magnetic metal particle. A method of forming the coating part is not particularly limited, and a known method can be employed. The coating part may be formed by carrying out a wet treatment to the soft magnetic metal particle, or the coating part may be formed by carrying out a dry treatment.

The first coating part can be formed by heat treating in oxidized atmosphere, and by carrying out a powder spattering method. During the heat treatment in the oxidized atmosphere, the soft magnetic metal particle is heat treated at a predetermined temperature in oxidized atmosphere, thereby Fe constituting the soft magnetic metal particle diffuses to the surface of the soft magnetic metal particle, then Fe binds with oxygen in atmosphere at the surface, thus dense oxides of Fe are formed. Thereby, the first coating part can be formed. In case other metal elements constituting the soft magnetic metal particle easily diffuse, then oxides of the other elements are included in the first coating part. The thickness of the first coating part can be regulated by a heat treating temperature, a length of time of heat treatment, and the like.

Figure 2:
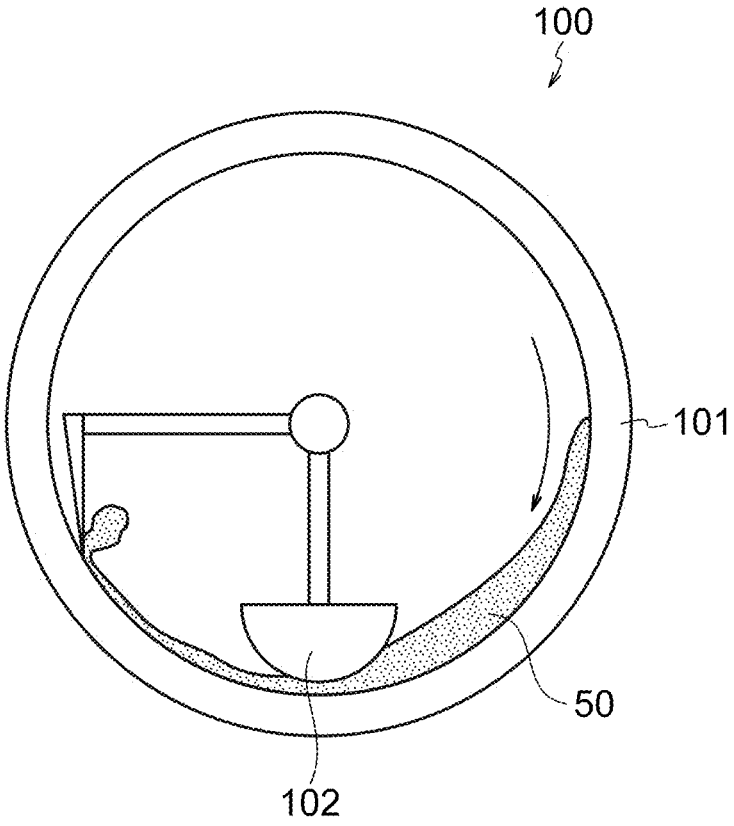
FIG. 2 is a schematic image of a cross section showing a constitution of powder coating apparatus used for forming a second coating part.

Also, the second coating part can be formed by a mechanochemical coating method, a phosphate treatment method, a sol-gel method, and the like. As the mechanochemical coating method, for example, a powder coating apparatus 100 shown in FIG. 2 is used. The soft magnetic metal powder formed with the first coating part, and the powder form coating material of the materials (compounds of P, Si, Bi, Zn, and the like) constituting the second coating part are introduced into a container 101 of the powder coating apparatus. After introducing these, the container 101 is rotated, thereby a mixture 50 made of the soft magnetic metal powder and the powder form coating material is compressed between a grinder 102 and an inner wall of the container 101 and heat is generated by friction. Due to this friction heat, the powder form coating material is softened, the powder form coating material is adhered to the surface of the soft magnetic metal particle by a compression effect, thereby the second coating part can be formed.

By forming the second coating part using a mechanochemical coating method, even when oxides of Fe which are not dense ($Fe_3O_4$, iron hydroxide, iron oxyhydroxide, and the like) are included in the first coating part, oxides of Fe which are not dense are removed by effects of compression and friction while coating, hence most part of oxides of Fe included in the first coating part can easily be dense oxides of Fe which contribute to improve the withstand voltage. Note that, as oxides of Fe which are not dense are removed, the surface of the first coating part becomes relatively smooth.

In a mechanochemical coating method, a rotation speed of the container, a distance between a grinder and an inner wall of the container, and the like can be adjusted to control the heat generated by friction, thereby the temperature of the mixture of the soft magnetic metal powder and the powder form coating material can be controlled. In the present embodiment, the temperature is preferably 50° C. or higher and 150° C. or lower. By setting within such temperature range, the second coating part can be easily formed so as to cover the first coating part.

(4.2. Method of Producing Dust Core)

The dust core is produced by using the above mentioned soft magnetic metal powder. A method of production is not particularly limited, and a known method can be employed. First, the soft magnetic metal powder including the soft magnetic metal particle formed with the coating part, and a known resin as the binder are mixed to obtain a mixture. Also, if needed, the obtained mixture may be formed into granulated powder. Further, the mixture or the granulated powder is filled into a metal mold and compression molding is carried out, and a molded body having a shape of the core dust to be produced is obtained. The obtained molded body, for example, is carried out with a heat treatment at 50 to 200° C. to cure the resin, and the dust core having a predetermined shape of which the soft magnetic metal particles are fixed via the resin can be obtained. By winding a wire for a predetermined number of turns to the obtained dust core, the magnetic component such as an inductor and the like can be obtained.

Also, the above mentioned mixture or granulated powder and an air coil formed by winding a wire for predetermined number of turns may be filled in a metal mold and compress mold to embed the coil inside, thereby the molded body embedded with a coil inside may be obtained. By carrying out a heat treatment to the obtained molded body, the dust core having a predetermined shape embedded with the coil can be obtained. A coil is embedded inside of such dust core, thus it can function as the magnetic component such as an inductor and the like.

Hereinabove, the embodiment of the present invention has been described, however the present invention is not to be limited thereto, and various modifications may be done within scope of the present invention.

EXAMPLES

Hereinafter, the present invention is described in further detail using examples, however the present invention is not to be limited to these examples.

(Sample No. 1 to 69)

First, powder including particles constituted by a soft magnetic metal having a composition shown in Table 1 and Table 2 and having an average particle size D50 shown in Table 1 and Table 2 were prepared. The prepared powder was subjected to heat treatment under the condition shown in Table 1 and Table 2. By carrying out such heat treatment, Fe and other metal elements constituting the soft magnetic metal particle diffuses through the surface of the soft magnetic metal particle, and bind with oxygen at the surface of the soft magnetic metal particle, thereby the first coating part including oxides of Fe was formed.

Note that, the heat treatment was not carried out and the first coating part was not formed to Sample No. 1, 9, 11, 13, 15, 17, 19, 21, 23, 25, 29, 31, 33, 37, 41, 43, 46, 48, 50, 52, 54, 56, 58, 60, 62, 64, 66, and 68. Also, the heat treatment was carried out to Sample No. 26 and 34, however oxides of Fe did not form on the particle surface. This is because amorphous alloy and nanocrystal alloy are harder to be oxidized compared to crystalline alloy, thus oxides of Fe did not form depending on the composition even the heat treatment was carried out under the condition shown in Table 1. Also, samples according to Sample No. 1, 9, 11 and 13 were left in air for 30 days, and a natural oxide film was formed on the surface of the soft magnetic metal particle as the first coating part.

A coercivity of the powder after the heat treatment was measured. 20 mg of powder and paraffin were placed in a plastic case of ϕ 6 mm×5 mm, and the paraffin was melted and solidified to fix the powder, thereby the coercivity was measured using a coercimeter (K-HC1000) made by TOHOKU STEEL Co., Ltd. A magnetic field was 150 kA/m while measuring the coercivity. The results are shown in Table 1 and Table 2.

Also, the powder after the heat treatment was subjected to X-ray diffraction analysis and the average crystallite size was calculated. The results are shown in Table 1 and Table 2. Note that, Sample No. 21 to 32 were amorphous, hence the crystallite size was not measured.

TABLE 1

| | Soft magnetic metal particle | | | Heat treating condition | | 1st coating | Property after heat treatment | |
|---|---|---|---|---|---|---|---|---|
| Sample No. | Material | Composition | Partide size D50 (μm) | Heat treating Temp. | Oxygen concentration (ppm) | part Oxides of Fe | Crystallite size (nm) | Coercivity (Oe) |
| 1 | Fe-based | Fe | 1.2 | — | — | Formed | 10 | 10 |
| 2 | Fe-based | Fe | 1.2 | 200 | 1000 | Formed | 10 | 10 |
| 3 | Fe-based | Fe | 1.2 | 300 | 100 | Formed | 10 | 10 |
| 4 | Fe-based | Fe | 1.2 | 300 | 500 | Formed | 10 | 10 |
| 5 | Fe-based | Fe | 1.2 | 300 | 1000 | Formed | 10 | 10 |
| 6 | Fe-based | Fe | 1.2 | 350 | 500 | Formed | 35 | 20 |
| 7 | Fe-based | Fe | 1.2 | 400 | 500 | Formed | 50 | 25 |
| 8 | Fe-based | Fe | 1.2 | 450 | 500 | Formed | 80 | 135 |
| 9 | Fe-based | Fe | 0.5 | — | — | Formed | 10 | 10 |
| 10 | Fe-based | Fe | 0.5 | 300 | 500 | Formed | 10 | 10 |

TABLE 1-continued

| Sample No. | Soft magnetic metal particle: Material | Soft magnetic metal particle: Composition | Soft magnetic metal particle: Partide size D50 (μm) | Heat treating condition: Heat treating Temp. | Heat treating condition: Oxygen concentration (ppm) | 1st coating: part Oxides of Fe | Property after heat treatment: Crystallite size (nm) | Property after heat treatment: Coercivity (Oe) |
|---|---|---|---|---|---|---|---|---|
| 11 | Fe-based | Fe | 3 | — | — | Formed | 10 | 10 |
| 12 | Fe-based | Fe | 3 | 300 | 500 | Formed | 10 | 10 |
| 13 | Fe-based | Fe | 5.0 | — | — | Formed | 30 | 20 |
| 14 | Fe-based | Fe | 5.0 | 300 | 500 | Formed | 30 | 20 |
| 15 | Fe—Ni-based | 55Fe—45Ni | 5.0 | — | — | Not formed | 1000 | 5 |
| 16 | Fe—Ni-based | 55Fe—45Ni | 5.0 | 300 | 500 | Formed | 1000 | 6 |
| 17 | Fe—Ni-based | 55Fe—45Ni | 10.0 | — | — | Not formed | 3200 | 7 |
| 18 | Fe—Ni-based | 55Fe—45Ni | 10.0 | 300 | 500 | Formed | 3200 | 6 |
| 19 | Fe—Ni-based | 16Fe—79Ni—5Mo | 1.2 | — | — | Not formed | 150 | 10 |
| 20 | Fe—Ni-based | 16Fe—79Ni—5Mo | 1.2 | 300 | 500 | Formed | 150 | 10 |
| 21 | Fe-based amorphous | 87.55Fe—6.7Si—2.5Cr—2.5B—0.75C | 5 | — | — | Not formed | Amorphous | 10.2 |
| 22 | Fe-based amorphous | 87.55Fe—6.7Si—2.5Cr—2.5B—0.75C | 5 | 300 | 2000 | Formed | Amorphous | 10.3 |
| 23 | Fe-based amorphous | 87.55Fe—6.7Si—2.5Cr—2.5B—0.75C | 10 | — | — | Not formed | Amorphous | 10.2 |
| 24 | Fe-based amorphous | 87.55Fe—6.7Si—2.5Cr—2.5B—0.75C | 10 | 300 | 2000 | Formed | Amorphous | 10.3 |
| 25 | Fe-based amorphous | 87.55Fe—6.7Si—2.5Cr—2.5B—0.75C | 20 | — | — | Not formed | Amorphous | 1.7 |
| 26 | Fe-based amorphous | 87.55Fe—6.7Si—2.5Cr—2.5B—0.75C | 20 | 300 | 500 | Not formed | Amorphous | 1.8 |
| 27 | Fe-based amorphous | 87.55Fe—6.7Si—2.5Cr—2.5B—0.75C | 20 | 300 | 2000 | Formed | Amorphous | 1.8 |
| 28 | Fe-based amorphous | 87.55Fe—6.7Si—2.5Cr—2.5B—0.75C | 20 | 300 | 10000 | Formed | Amorphous | 2.6 |
| 29 | Fe-based amorphous | 87.55Fe—6.7Si—2.5Cr—2.5B—0.75C | 30 | — | — | Not formed | Amorphous | 1.9 |
| 30 | Fe-based amorphous | 87.55Fe—6.7Si—2.5Cr—2.5B—0.75C | 30 | 300 | 2000 | Formed | Amorphous | 1.7 |
| 31 | Fe-based amorphous | 87.55Fe—6.7Si—2.5Cr—2.5B—0.75C | 50 | — | — | Not formed | Amorphous | 2.2 |
| 32 | Fe-based amorphous | 87.55Fe—6.7Si—2.5Cr—2.5B—0.75C | 50 | 300 | 2000 | Formed | Amorphous | 2.5 |

TABLE 2

| Sample No. | Soft magnetic metal particle: Material | Soft magnetic metal particle: Composition | Soft magnetic metal particle: Particle size D50 (μm) | Heat treating condition: Heat treating Temp. | Heat treating condition: Oxygen concentration (ppm) | 1st coating: part Oxides of Fe | Property after heat treatment: Crystallite size (nm) | Property after heat treatment: Coercivity (Oe) |
|---|---|---|---|---|---|---|---|---|
| 33 | Nanocrystal | 83.4Fe—5.6Nb—2B—7.7Si—1.3Cu | 5 | — | — | Not formed | 20 | 0.5 |
| 34 | Nanocrystal | 83.4Fe—5.6Nb—2B—7.7Si—1.3Cu | 5 | 300 | 500 | Not formed | 20 | 0.3 |
| 35 | Nanocrystal | 83.4Fe—5.6Nb—2B—7.7Si—1.3Cu | 5 | 300 | 2000 | Formed | 24 | 0.4 |
| 36 | Nanocrystal | 83.4Fe—5.6Nb—2B—7.7Si—1.3Cu | 5 | 300 | 5000 | Formed | 25 | 0.5 |
| 37 | Nanocrystal | 83.4Fe—5.6Nb—2B—7.7Si—1.3Cu | 25 | — | — | Not formed | 24 | 0.5 |
| 38 | Nanocrystal | 83.4Fe—5.6Nb—2B—7.7Si—1.3Cu | 25 | 300 | 500 | Formed | 20 | 0.6 |
| 39 | Nanocrystal | 83.4Fe—5.6Nb—2B—7.7Si—1.3Cu | 25 | 300 | 2000 | Formed | 24 | 0.7 |
| 40 | Nanocrystal | 83.4Fe—5.6Nb—2B—7.7Si—1.3Cu | 25 | 300 | 5000 | Formed | 25 | 0.6 |
| 41 | Nanocrystal | 86.2Fe—12Nb—1.8B | 5 | — | — | Not formed | 11 | 1.7 |
| 42 | Nanocrystal | 86.2Fe—12Nb—1.8B | 5 | 300 | 500 | Formed | 10 | 1.8 |
| 43 | Nanocrystal | 86.2Fe—12Nb—1.8B | 25 | — | — | Not formed | 12 | 1.5 |
| 44 | Nanocrystal | 86.2Fe—12Nb—1.8B | 25 | 300 | 500 | Formed | 13 | 1.6 |
| 45 | Nanocrystal | 86.2Fe—12Nb—1.8B | 25 | 300 | 2000 | Formed | 11 | 1.5 |
| 46 | Fe—Si—Cr-based | 90.5Fe—4.5Si—5Cr | 5 | — | — | Not formed | 1000 | 8 |
| 47 | Fe—Si—Cr-based | 90.5Fe—4.5Si—5Cr | 5 | 300 | 1000 | Formed | 1000 | 8 |
| 48 | Fe—Si—Cr-based | 90.5Fe—4.5Si—5 Cr | 20 | — | — | Not formed | 2000 | 7 |
| 49 | Fe—Si—Cr-based | 90.5Fe—4.5Si—5 Cr | 20 | 300 | 1000 | Formed | 2000 | 7 |
| 50 | Fe—Si—Cr-based | 90.5Fe—4.5Si—5 Cr | 30 | — | — | Not formed | 2000 | 7 |
| 51 | Fe—Si—Cr-based | 90.5Fe—4.5Si—5Cr | 30 | 300 | 1000 | Formed | 2000 | 6 |
| 52 | Fe—Si—Cr-based | 90.5Fe—4.5Si—5 Cr | 50 | — | — | Not formed | 2000 | 7 |
| 53 | Fe—Si—Cr-based | 90.5Fe—4.5Si—5Cr | 50 | 300 | 1000 | Formed | 2000 | 6 |
| 54 | Fe—Si-based | 90Fe—10Si | 20 | — | — | Not formed | 3000 | 6 |
| 55 | Fe—Si-based | 90Fe—10Si | 20 | 300 | 1000 | Formed | 3000 | 6 |
| 56 | Fe—Si-based | 93.5Fe—6.5Si | 5 | — | — | Not formed | 1300 | 8 |
| 57 | Fe—Si-based | 93.5Fe—6.5Si | 5 | 300 | 1000 | Formed | 1300 | 8 |
| 58 | Fe—Si-based | 93.5Fe—6.5Si | 20 | — | — | Not formed | 3400 | 5 |
| 59 | Fe—Si-based | 93.5Fe—6.5Si | 20 | 300 | 1000 | Formed | 3400 | 5 |
| 60 | Fe—Si-based | 95.5Fe—4.5Si | 20 | — | — | Not formed | 3500 | 7 |
| 61 | Fe—Si-based | 95.5Fe—4.5Si | 20 | 300 | 1000 | Formed | 3500 | 7 |
| 62 | Fe—Si-based | 98Fe—3Si | 20 | — | — | Not formed | 3300 | 9 |
| 63 | Fe—Si-based | 98Fe—3Si | 20 | 300 | 1000 | Formed | 3300 | 9 |
| 64 | Fe—Si—Al-based | 85Fe—9.5Si—5.5Al | 10 | — | — | Not formed | 3300 | 9 |
| 65 | Fe—Si—Al-based | 85Fe—9.5Si—5.5Al | 10 | 300 | 1000 | Formed | 3300 | 9 |
| 66 | Fe—Ni—Si—Co-based | 50.5Fe—44.5Ni—2Si—3Co | 5 | — | — | Not formed | 1200 | 8 |
| 67 | Fe—Ni—Si—Co-based | 50.5Fe—44.5Ni—2Si—3Co | 5 | 300 | 1000 | Formed | 1200 | 9 |
| 68 | Fe—Ni—Si—Co-based | 50.5Fe—44.5Ni—2Si—3Co | 20 | — | — | Not formed | 3300 | 9 |
| 69 | Fe—Ni—Si—Co-based | 50.5Fe—44.5Ni—2Si—3Co | 20 | 300 | 1000 | Formed | 3300 | 9 |

Experiments 1 to 69

The powder (Sample No. 1 to 69) after the heat treatment was introduced to the container of the powder coating apparatus together with the powder glass (coating material) having the composition shown in Table 3 and Table 4, then the powder glass was coated on the surface of the particle formed with the first coating part to form the second coating part. Thereby, the soft magnetic metal powder was obtained. The powder glass was added in an amount of 3 wt % with respect to 100 wt % of the powder including the particle formed with the first coating part when the average particle size (D50) of the powder was 3 μm or less; the powder glass was added in an amount of 1 wt % when the average particle size (D50) of the powder was 5 μm or more and 10 μm or less; and the powder glass was added in an amount of 0.5 wt % when the average particle size (D50) of the powder was 20 μm or more. This is because the amount of the powder glass necessary for forming the predetermined thickness differs depending on the particle size of the soft magnetic metal powder to which the second coating part is formed.

In the present example, for $P_2O_5$—ZnO—$R_2O$—$Al_2O_3$-based powder glass as a phosphate-based glass, $P_2O_5$ was 50 wt %, ZnO was 12 wt %, $R_2O$ was 20 wt %, $Al_2O_3$ was 6 wt %, and the rest was subcomponents.

Note that, the present inventors have carried out the same experiment to a glass having a composition including $P_2O_s$ of 60 wt %, ZnO of 20 wt %, $R_2O$ of 10 wt %, $Al_2O_3$ of 5 wt %, and the rest made of subcomponents, and the like; and have verified that the same results as mentioned in below can be obtained.

Also, in the present example, for $Bi_2O_3$—ZnO—$B_2O_3$—$SiO_2$-based powder glass as a bismuthate-based glass, $Bi_2O_3$ was 80 wt %, ZnO was 10 wt %, $B_2O_3$ was 5 wt %, and $SiO_2$ was 5 wt %. As a bismuthate-based glass, a glass having other composition was also subjected to the same experiment, and was confirmed that the same results as described in below can be obtained.

Also, in the present example, for BaO—ZnO—$B_2O_3$—$SiO_2$—$Al_2O_3$-based powder glass as a borosilicate-based glass, BaO was 8 wt %, ZnO was 23 wt %, $B_2O_3$ was 19 wt %, $SiO_2$ was 16 wt %, $Al_2O_3$ was 6 wt %, and the rest was subcomponents. As a borosilicate-based glass, a glass having other composition was also subjected to the same experiment, and was confirmed that the same results as describe in below can be obtained.

Next, the obtained soft magnetic metal powder was evaluated for types of oxides included in the first coating part and a ratio of trivalent Fe among oxides of Fe included in the first coating part using STEM. Also, the soft magnetic metal powder was solidified and the resistivity was evaluated. Further, the coercivity of the powder after forming the second coating part was measured.

For the ratio of trivalent Fe, ELNES spectrum of oxygen K-edge of oxides of Fe included in the first coating part was obtained and analyzed by spherical aberration corrected STEM-EELS method. Specifically, in a field of observation of 170 nm×170 nm, ELNES spectrum of oxygen K-edge of oxides of Fe was obtained, and regarding the spectrum, fitting by a least square method using ELNES spectrum of oxygen K-edge of each standard substance of FeO and $Fe_2O_3$ was carried out.

Calibration was carried out so that a predetermined peak energy of each spectrum matches and fitting by a least square method was carried out within a range of 520 to 590 eV using MLLS fitting of Digital Micrograph made by GATAN Inc. According to results obtained by above mentioned fitting, the ratio derived from $Fe_2O_3$ spectrum was calculated, and the ratio of trivalent Fe was calculated. The results are shown in Table 3 and Table 4.

The resistivity of the powder was measured using a powder resistivity measurement apparatus, and a resistivity while applying 0.6 t/cm$^2$ of pressure to the powder was measured. In the present examples, among the samples having same average particle size (D50) of the soft magnetic metal powder, a sample showing higher resistivity than the resistivity of a sample of the comparative example was considered good. The results are shown in Table 3 and Table 4.

The coercivity of the powder after forming the second coating part was measured under the same measuring condition as the coercivity of the powder after forming the first coating part that is before forming the second coating part. Also, a ratio of the coercivity before and after forming the second coating part was calculated. The results are shown in Table 3 and Table 4.

Figure 3:
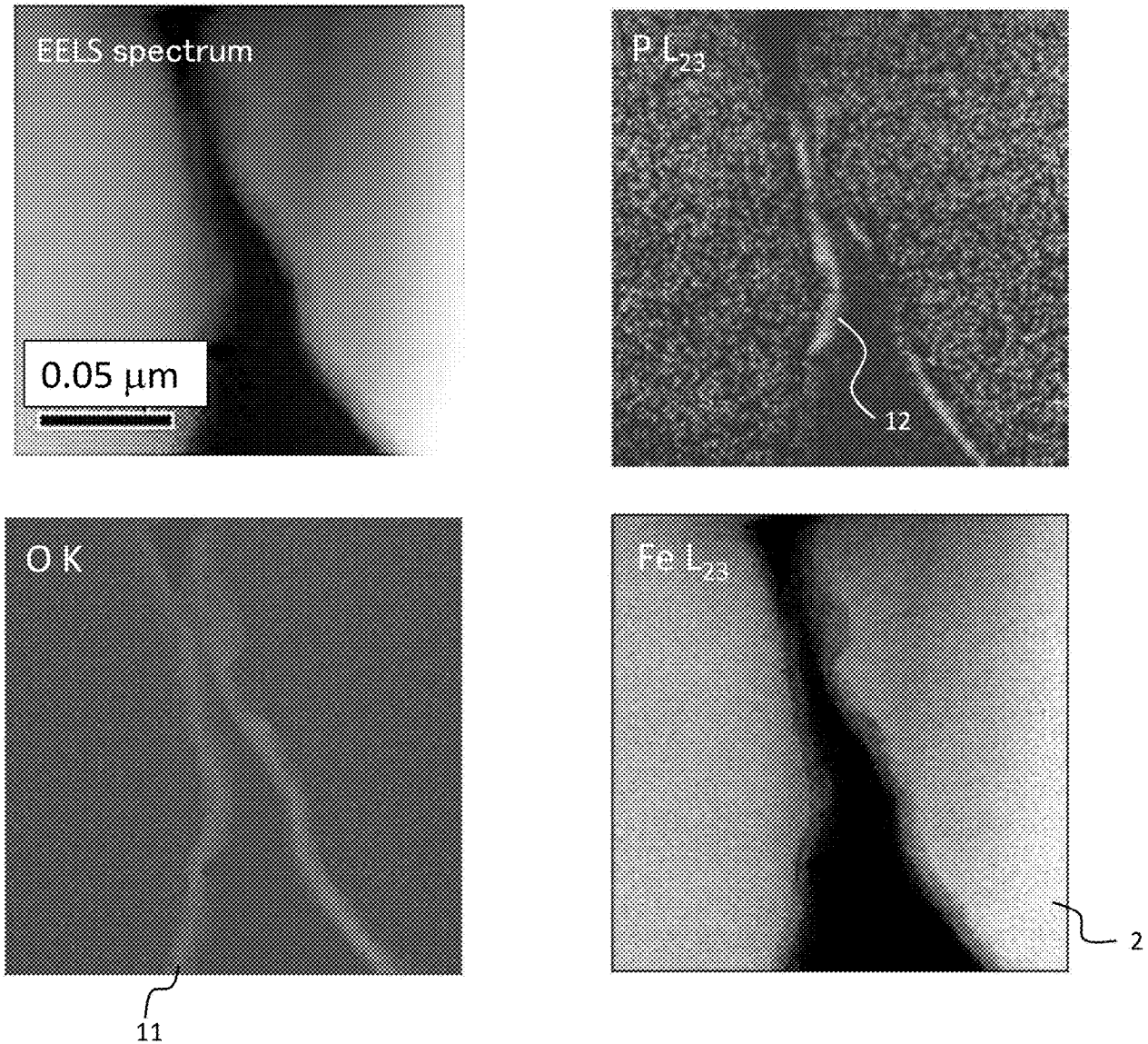
FIG. 3 is STEM-EELS spectrum image near the coating part of the coated particle in examples of the present invention.

Also, among the produced soft magnetic metal powder, to a sample of Experiment 5, a bright-field image near the coating part of the coated particle was obtained by STEM. FIG. 3 shows a spectrum image of EELS from the obtained bright-field image. Also, a spectrum analysis of EELS was carried out to an spectrum image of EELS shown in FIG. 3, and an element mapping was done. According to the results of EELS spectrum image shown in FIG. 3 and element mapping, it was confirmed that the coating part was constituted by the first coating part and the second coating part.

Next, the dust core was evaluated. The total amount of epoxy resin as a heat curing resin and imide resin as a curing agent was weighed so that it satisfied the amount shown in Table 3 and Table 4 with respect to 100 wt % of the obtained soft magnetic metal powder. Then, acetone was added to make a solution, and this solution and the soft magnetic metal powder were mixed.

After mixing, granules obtained by evaporating acetone were sieved using 355 μm mesh. Then, this was introduced into a metal mold of toroidal shape having an outer diameter of 11 mm and an inner diameter of 6.5 mm, then molding pressure of 3.0 t/cm$^2$ was applied, thereby a molded body of the dust core was obtained. The obtained molded body of the dust core was treated at 180° C. for 1 hour to cure the resin, thereby the dust core was obtained. Then, In—Ga electrodes were formed to both ends of this dust core, and the resistivity of the dust core was measured by Ultra High Resistance Meter. In the present examples, a sample having a resistivity of $10^7$ Ωcm or more was considered "Excellent (◎)", a sample having a resistivity of $10^6$ Ωcm or more was considered "Good (○)", and a sample having a resistivity of less than $10^6$ Ωcm was considered "Bad (x)". The results are shown in Table 3 and Table 4.

Next, the produced dust core was subjected to a heat resistance test at 180° C. for 1 hour in air. The resistivity of the sample after the heat resistance test was measured as similar to the above. In the present example, a sample was considered "Bad (x)" when the resistivity dropped by 3 digits or more from the resistivity before the heat resistance test; a sample of which the resistivity dropped by 2 digits or less was considered "Fair (Δ)", and a sample of which the resistivity dropped by 1 digits or less was considered "Good (○)". When a sample had the resistivity of $10^6$ Ωcm or more, it was considered "Excellent (◎)". The results are shown in Table 3 and Table 4.

Further, voltage was applied using a source meter on top and bottom of the dust core sample, and a value of voltage when 1 mA of current flew was divided by a distance between electrodes, thereby a withstand voltage was obtained. In the present example, among the samples having same composition of the soft magnetic metal powder, same average particle size (D50), and same amount of resin used for forming the dust core; a sample showing a higher withstand voltage than the withstand voltage of a sample of the comparative example was considered good. This is because the withstand voltage changes depending on the amount of resin. The results are shown in Table 3 and Table 4.

TABLE 3

| | | Soft magnetic metal powder | | | | | | | | Dust core | | | |
|---|---|---|---|---|---|---|---|---|---|---|---|---|---|
| | | | | | | Property | | | | | | Property | |
| | | | 1st coating part | | | | Coercivity Hc (Oe) | | | | | Resistivity (Ω · cm) | |
| Experiment No. | | Soft magnetic metal particle Sample No. | Oxides | EELS $Fe^{3+}$ amount (%) | 2nd coating part Coating material | Resistivity at 0.6 t/cm$^2$ (Ω · cm) | before forming 2nd coating part | After forming 2nd coating part | After forming/ Before forming | Resin amount (wt %) | Withstand voltage (V/mm) | Before heat resistance test | After heat resistance test 180° C. × 1 h |
| 1 | Comparative example | 1 | $FeO + Fe_2O_3 + Fe_3O_4$ | 32 | $P_2O_5$—ZnO—$R_2O$—$Al_2O_3$ | $3.0 \times 10^2$ | 10 | 11 | 1.1 | 4 | 181 | x | x |
| 2 | Example | 2 | $Fe_2O_3 + Fe_3O_4$ | 57 | $P_2O_5$—ZnO—$R_2O$—$Al_2O_3$ | $1.0 \times 10^3$ | 10 | 10 | 1.0 | 4 | 350 | ○ | ○ |
| 3 | Example | 3 | $Fe_2O_3 + Fe_3O_4$ | 58 | $P_2O_5$—ZnO—$R_2O$—$Al_2O_3$ | $3.0 \times 10^3$ | 10 | 11 | 1.1 | 4 | 450 | ◎ | ○ |
| 4 | Example | 4 | $Fe_2O_3 + Fe_3O_4$ | 64 | $P_2O_5$—ZnO—$R_2O$—$Al_2O_3$ | $5.0 \times 10^3$ | 10 | 12 | 1.2 | 4 | 523 | ◎ | ◎ |
| 5 | Example | 5 | $Fe_2O_3 + Fe_3O_4$ | 79 | $P_2O_5$—ZnO—$R_2O$—$Al_2O_3$ | $9.0 \times 10^3$ | 10 | 12 | 1.2 | 4 | 569 | ◎ | ◎ |
| 6 | Example | 6 | $Fe_2O_3 + Fe_3O_4$ | 80 | $P_2O_5$—ZnO—$R_2O$—$Al_2O_3$ | $7.0 \times 10^4$ | 20 | 21 | 1.1 | 4 | 783 | ◎ | ◎ |
| 7 | Example | 7 | $Fe_2O_3 + Fe_3O_4$ | 77 | $P_2O_5$—ZnO—$R_2O$—$Al_2O_3$ | $1.0 \times 10^5$ | 25 | 28 | 1.1 | 4 | 632 | ◎ | ○ |
| 8 | Example | 8 | $Fe_2O_3 + Fe_3O_4$ | 51 | $P_2O_5$—ZnO—$R_2O$—$Al_2O_3$ | $2.0 \times 10^5$ | 135 | 321 | 2.4 | 4 | 542 | ◎ | Δ |
| 9 | Comparative example | 9 | $FeO + Fe_2O_3 + Fe_3O_4$ | 32 | $P_2O_5$—ZnO—$R_2O$—$Al_2O_3$ | $3.0 \times 10^2$ | 10 | 11 | 1.1 | 4 | 223 | x | x |
| 10 | Example | 10 | $Fe_2O_3 + Fe_3O_4$ | 67 | $P_2O_5$—ZnO—$R_2O$—$Al_2O_3$ | $2.0 \times 10^3$ | 10 | 12 | 1.2 | 4 | 345 | ◎ | ◎ |
| 11 | Comparative example | 11 | $FeO + Fe_2O_3 + Fe_3O_4$ | 33 | $P_2O_5$—ZnO—$R_2O$—$Al_2O_3$ | $3.0 \times 10^2$ | 10 | 11 | 1.1 | 3 | 245 | x | x |
| 12 | Example | 12 | $Fe_2O_3 + Fe_3O_4$ | 79 | $P_2O_5$—ZnO—$R_2O$—$Al_2O_3$ | $4.0 \times 10^3$ | 10 | 13 | 1.3 | 3 | 454 | ◎ | ◎ |
| 13 | Comparative example | 13 | $FeO + Fe_2O_3 + Fe_3O_4$ | 36 | $P_2O_5$—ZnO—$R_2O$—$Al_2O_3$ | $6.0 \times 10^1$ | 20 | 21 | 1.1 | 3 | 231 | x | x |
| 14 | Example | 14 | $Fe_2O_3 + Fe_3O_4$ | 83 | $P_2O_5$—ZnO—$R_2O$—$Al_2O_3$ | $1.0 \times 10^5$ | 20 | 25 | 1.3 | 3 | 432 | ◎ | ◎ |
| 15 | Comparative example | 15 | Not formed | — | $P_2O_5$—ZnO—$R_2O$—$Al_2O_3$ | $5.0 \times 10^2$ | 8 | 21 | 2.6 | 3 | 233 | x | ○ |
| 16 | Example | 16 | $Fe_2O_3 + Fe_3O_4$ + Ni oxides | 78 | $P_2O_5$—ZnO—$R_2O$—$Al_2O_3$ | $4.0 \times 10^4$ | 9 | 23 | 2.6 | 3 | 338 | ○ | ○ |
| 17 | Comparative example | 17 | Not formed | — | $P_2O_5$—ZnO—$R_2O$—$Al_2O_3$ | $3.0 \times 10^2$ | 11 | 14 | 1.3 | 3 | 188 | x | ○ |
| 18 | Example | 18 | $Fe_2O_3 + Fe_3O_4$ + Ni oxides | 78 | $P_2O_5$—ZnO—$R_2O$—$Al_2O_3$ | $8.0 \times 10^4$ | 12 | 14 | 1.2 | 3 | 375 | ○ | ○ |
| 19 | Comparative example | 19 | Not formed | — | $P_2O_5$—ZnO—$R_2O$—$Al_2O_3$ | $5.0 \times 10^2$ | 10 | 22 | 2.2 | 4 | 231 | ○ | Δ |
| 20 | Example | 20 | $Fe_2O_3 + Fe_3O_4$ + Ni oxides | 65 | $P_2O_5$—ZnO—$R_2O$—$Al_2O_3$ | $7.0 \times 10^3$ | 10 | 21 | 2.1 | 4 | 433 | ○ | ○ |
| 21 | Comparative example | 21 | Not formed | — | $P_2O_5$—ZnO—$R_2O$—$Al_2O_3$ | $1.0 \times 10^3$ | 8 | 12 | 1.5 | 3 | 232 | ○ | Δ |
| 22 | Example | 22 | $Fe_2O_3 + Fe_3O_4$ | 73 | $P_2O_5$—ZnO—$R_2O$—$Al_2O_3$ | $5.0 \times 10^5$ | 8 | 11 | 1.4 | 3 | 453 | ◎ | ◎ |
| 23 | Comparative example | 23 | Not formed | — | $P_2O_5$—ZnO—$R_2O$—$Al_2O_3$ | $1.0 \times 10^5$ | 1.7 | 2.4 | 1.4 | 2 | 148 | ◎ | x |

TABLE 3-continued

| | | Soft magnetic metal powder | | | | | | | | Dust core | | | |
|---|---|---|---|---|---|---|---|---|---|---|---|---|---|
| | | | | | | Property | | | | | | Property | |
| | | | 1st coating part | | | | Coercivity Hc (Oe) | | | | | Resistivity (Ω · cm) | |
| Experiment No. | | Soft magnetic metal particle Sample No. | Oxides | EELS $Fe^{3+}$ amount (%) | 2nd coating part Coating material | Resistivity at 0.6 t/cm$^2$ (Ω · cm) | before forming 2nd coating part | After forming 2nd coating part | After forming/ Before forming | Resin amount (wt %) | Withstand voltage (V/mm) | Before heat resistance test | After heat resistance test 180° C. × 1 h |
| 24 | Example | 24 | $Fe_2O_3 + Fe_3O_4$ | 74 | $P_2O_5$—ZnO—$R_2O$—$Al_2O_3$ | $1.0 \times 10^7$ | 1.8 | 3.2 | 1.8 | 2 | 357 | ◎ | ◎ |
| 25 | Comparative example | 25 | Not formed | — | $P_2O_5$—ZnO—$R_2O$—$Al_2O_3$ | $8.0 \times 10^5$ | 1.9 | 3.2 | 1.7 | 2 | 113 | ○ | x |
| 26 | Comparative example | 26 | Not formed | — | $P_2O_5$—ZnO—$R_2O$—$Al_2O_3$ | $1.0 \times 10^6$ | 2.6 | 4.1 | 1.6 | 2 | 243 | ○ | Δ |
| 27 | Example | 27 | $Fe_2O_3 + Fe_3O_4$ | 87 | $P_2O_5$—ZnO—$R_2O$—$Al_2O_3$ | $5.0 \times 10^7$ | 2.6 | 4.5 | 1.7 | 2 | 432 | ◎ | ◎ |
| 28 | Example | 28 | $Fe_2O_3 + Fe_3O_4$ | 74 | $P_2O_5$—ZnO—$R_2O$—$Al_2O_3$ | $6.0 \times 10^6$ | 1.7 | 3.3 | 1.9 | 2 | 365 | ◎ | ◎ |
| 29 | Comparative example | 29 | Not formed | — | $P_2O_5$—ZnO—$R_2O$—$Al_2O_3$ | $5.0 \times 10^6$ | 2.2 | 3.2 | 1.5 | 2 | 98 | ○ | x |
| 30 | Example | 30 | $Fe_2O_3 + Fe_3O_4$ | 74 | $P_2O_5$—ZnO—$R_2O$—$Al_2O_3$ | $8.0 \times 10^6$ | 2.5 | 3.9 | 1.6 | 2 | 377 | ◎ | ◎ |
| 31 | Comparative example | 31 | Not formed | — | $P_2O_5$—ZnO—$R_2O$—$Al_2O_3$ | $8.0 \times 10^6$ | 3.8 | 6.8 | 1.8 | 2 | 122 | ◎ | x |
| 32 | Example | 32 | $Fe_2O_3 + Fe_3O_4$ | 74 | $P_2O_5$—ZnO—$R_2O$—$Al_2O_3$ | $3.0 \times 10^7$ | 3.8 | 7.2 | 1.9 | 2 | 258 | ◎ | ◎ |

TABLE 4

| | | Soft magnetic metal powder | | | | | | | | Dust core | | | |
|---|---|---|---|---|---|---|---|---|---|---|---|---|---|
| | | | | | | Property | | | | | | Property | |
| | | | 1st coating part | | | | Coercivity Hc (Oe) | | | | | Resistivity (Ω · cm) | |
| Experiment No. | | Soft magnetic metal particle Sample No. | Oxides | EELS $Fe^{3+}$ amount (%) | 2nd coating part Coating material | Resistivity at 0.6 t/cm$^2$ (Ω · cm) | Before forming 2nd coating part | After forming 2nd coating part | After forming/ Before forming | Resin amount (wt %) | Withstand voltage (V/mm) | Before heat resistance test | After heat resistance test 180° C. × 1 h |
| 33 | Comparative example | 33 | Si oxides | — | $P_2O_5$—ZnO—$R_2O$—$Al_2O_3$ | $6.0 \times 10^4$ | 0.4 | 0.45 | 1.1 | 3 | 135 | ○ | x |
| 34 | Comparative example | 34 | Si oxides | — | $P_2O_5$—ZnO—$R_2O$—$Al_2O_3$ | $8.0 \times 10^4$ | 0.3 | 0.4 | 1.3 | 3 | 156 | ○ | Δ |
| 35 | Example | 35 | $Fe_2O_3$ + $Fe_3O_4$ + Si oxides + Cu oxides | 75 | $P_2O_5$—ZnO—$R_2O$—$Al_2O_3$ | $6.0 \times 10^5$ | 0.4 | 0.6 | 1.5 | 3 | 283 | ◎ | ◎ |
| 36 | Example | 36 | $Fe_2O_3$ + $Fe_3O_4$ + Si oxides + Cu oxides | 74 | $P_2O_5$—ZnO—$R_2O$—$Al_2O_3$ | $7.0 \times 10^5$ | 0.5 | 0.7 | 1.4 | 3 | 292 | ◎ | ◎ |
| 37 | Comparative example | 37 | Si oxides | — | $P_2O_5$—ZnO—$R_2O$—$Al_2O_3$ | $2.0 \times 10^6$ | 0.5 | 0.7 | 1.4 | 2 | 103 | ○ | x |
| 38 | Comparative example | 38 | $Fe_2O_3$ + $Fe_3O_4$ + Si oxides + Cu oxides | 46 | $P_2O_5$—ZnO—$R_2O$—$Al_2O_3$ | $3.0 \times 10^6$ | 0.6 | 0.8 | 1.3 | 2 | 206 | ○ | Δ |
| 39 | Example | 39 | $Fe_2O_3$ + $Fe_3O_4$ + Si oxides + Cu oxides | 79 | $P_2O_5$—ZnO—$R_2O$—$Al_2O_3$ | $1.0 \times 10^7$ | 0.7 | 0.9 | 1.3 | 2 | 343 | ◎ | ◎ |
| 40 | Example | 40 | $Fe_2O_3$ + $Fe_3O_4$ + Si oxides + Cu oxides | 80 | $P_2O_5$—ZnO—$R_2O$—$Al_2O_3$ | $5.0 \times 10^7$ | 0.6 | 0.9 | 1.5 | 2 | 382 | ◎ | ◎ |
| 41 | Comparative example | 41 | Not formed | — | $P_2O_5$—ZnO—$R_2O$—$Al_2O_3$ | $3.0 \times 10^4$ | 2.1 | 2.4 | 1.1 | 3 | 134 | ○ | x |
| 42 | Example | 42 | $Fe_2O_3$ + $Fe_3O_4$ | 77 | $P_2O_5$—ZnO—$R_2O$—$Al_2O_3$ | $3.0 \times 10^5$ | 2.1 | 2.4 | 1.1 | 3 | 255 | ◎ | ◎ |
| 43 | Comparative example | 43 | Not formed | — | $P_2O_5$—ZnO—$R_2O$—$Al_2O_3$ | $3.0 \times 10^5$ | 1.5 | 1.6 | 1.1 | 2 | 103 | ○ | x |
| 44 | Example | 44 | $Fe_2O_3$ + $Fe_3O_4$ | 74 | $P_2O_5$—ZnO—$R_2O$—$Al_2O_3$ | $3.0 \times 10^6$ | 1.6 | 1.8 | 1.1 | 2 | 254 | ◎ | ◎ |
| 45 | Example | 45 | $Fe_2O_3$ + $Fe_3O_4$ | 79 | $P_2O_5$—ZnO—$R_2O$—$Al_2O_3$ | $7.0 \times 10^6$ | 1.5 | 1.9 | 1.3 | 2 | 306 | ◎ | ◎ |
| 46 | Comparative example | 46 | Not formed | — | $P_2O_5$—ZnO—$R_2O$—$Al_2O_3$ | $5.0 \times 10^3$ | 8 | 21 | 2.6 | 3 | 245 | ○ | x |
| 47 | Example | 47 | $Fe_2O_3$ + $Fe_3O_4$ + Si oxides + Cr oxides | 72 | $P_2O_5$—ZnO—$R_2O$—$Al_2O_3$ | $2.0 \times 10^5$ | 5 | 23 | 2.9 | 3 | 356 | ◎ | ○ |
| 48 | Comparative example | 48 | Not formed | — | $P_2O_5$—ZnO—$R_2O$—$Al_2O_3$ | $3.0 \times 10^4$ | 7 | 24 | 3.4 | 2 | 104 | x | x |
| 49 | Example | 49 | $Fe_2O_3$ + $Fe_3O_4$ + Si oxides + Cr oxides | 63 | $P_2O_5$—ZnO—$R_2O$—$Al_2O_3$ | $7.0 \times 10^5$ | 7 | 23 | 3.3 | 2 | 289 | ○ | ○ |
| 50 | Comparative example | 50 | Not formed | — | $P_2O_5$—ZnO—$R_2O$—$Al_2O_3$ | $1.0 \times 10^4$ | 7 | 22 | 3.1 | 2 | 124 | x | x |
| 51 | Example | 51 | $Fe_2O_3$ + $Fe_3O_4$ + Si oxides + Cr oxides | 73 | $P_2O_5$—ZnO—$R_2O$—$Al_2O_3$ | $6.0 \times 10^5$ | 6 | 24 | 4.0 | 2 | 301 | ○ | ○ |
| 52 | Comparative example | 52 | Not formed | — | $P_2O_5$—ZnO—$R_2O$—$Al_2O_3$ | $3.0 \times 10^4$ | 7 | 24 | 3.4 | 2 | 94 | x | x |
| 53 | Example | 53 | $Fe_2O_3$ + $Fe_3O_4$ + Si oxides + Cr oxides | 77 | $P_2O_5$—ZnO—$R_2O$—$Al_2O_3$ | $2.0 \times 10^6$ | 6 | 22 | 3.7 | 2 | 305 | ○ | ○ |

TABLE 4-continued

| | | Soft magnetic metal powder | | | | | | | | Dust core | | | |
|---|---|---|---|---|---|---|---|---|---|---|---|---|---|
| | | | | | | Property | | | | | | Property | |
| | | | 1st coating part | | | | Coercivity Hc (Oe) | | | | | Resistivity (Ω · cm) | |
| Experiment No. | | Soft magnetic metal particle Sample No. | Oxides | EELS $Fe^{3+}$ amount (%) | 2nd coating part Coating material | Resistivity at 0.6 t/cm$^2$ (Ω · cm) | Before forming 2nd coating part | After forming 2nd coating part | After forming/ Before forming | Resin amount (wt %) | Withstand voltage (V/mm) | Before heat resistance test | After heat resistance test 180° C. × 1 h |
| 54 | Comparative example | 54 | Not formed | — | $P_2O_5$—ZnO—$R_2O$—$Al_2O_3$ | $4.0 \times 10^4$ | 6 | 18 | 3.0 | 2 | 84 | x | x |
| 55 | Example | 55 | $Fe_2O_3$ + $Fe_3O_4$ + Si oxides | 66 | $P_2O_5$—ZnO—$R_2O$—$Al_2O_3$ | $3.0 \times 10^5$ | 6 | 15 | 2.5 | 2 | 289 | ○ | ○ |
| 56 | Comparative example | 56 | Not formed | — | $P_2O_5$—ZnO—$R_2O$—$Al_2O_3$ | $3.0 \times 10^3$ | 8 | 17 | 2.1 | 3 | 123 | x | x |
| 57 | Example | 57 | $Fe_2O_3$ + $Fe_3O_4$ + Si oxides | 65 | $P_2O_5$—ZnO—$R_2O$—$Al_2O_3$ | $3.0 \times 10^4$ | 7 | 18 | 2.6 | 3 | 345 | ○ | ○ |
| 58 | Comparative example | 58 | Not formed | — | $P_2O_5$—ZnO—$R_2O$—$Al_2O_3$ | $6.0 \times 10^4$ | 5 | 16 | 3.2 | 2 | 97 | x | x |
| 59 | Example | 59 | $Fe_2O_3$ + $Fe_3O_4$ + Si oxides | 68 | $P_2O_5$—ZnO—$R_2O$—$Al_2O_3$ | $6.0 \times 10^5$ | 5 | 18 | 3.6 | 2 | 301 | ○ | ○ |
| 60 | Comparative example | 60 | Not formed | — | $P_2O_5$—ZnO—$R_2O$—$Al_2O_3$ | $2.0 \times 10^4$ | 7 | 15 | 2.1 | 2 | 121 | x | x |
| 61 | Example | 61 | $Fe_2O_3$ + $Fe_3O_4$ + Si oxides | 63 | $P_2O_5$—ZnO—$R_2O$—$Al_2O_3$ | $3.0 \times 10^5$ | 7 | 16 | 2.3 | 2 | 333 | ○ | ○ |
| 62 | Comparative example | 62 | Not formed | — | $P_2O_5$—ZnO—$R_2O$—$Al_2O_3$ | $4.0 \times 10^4$ | 9 | 18 | 2.0 | 2 | 109 | x | x |
| 63 | Example | 63 | $Fe_2O_3$ + $Fe_3O_4$ + Si oxides | 72 | $P_2O_5$—ZnO—$R_2O$—$Al_2O_3$ | $2.0 \times 10^5$ | 9 | 19 | 2.1 | 2 | 367 | ○ | ○ |
| 64 | Comparative example | 64 | Not formed | — | $P_2O_5$—ZnO—$R_2O$—$Al_2O_3$ | $3.0 \times 10^4$ | 9 | 21 | 2.3 | 3 | 145 | x | x |
| 65 | Example | 65 | $Fe_2O_3$ + $Fe_3O_4$ + Si oxides + Al oxides | 72 | $P_2O_5$—ZnO—$R_2O$—$Al_2O_3$ | $3.0 \times 10^6$ | 9 | 22 | 2.4 | 3 | 322 | ○ | ○ |
| 66 | Comparative example | 66 | Not formed | — | $P_2O_5$—ZnO—$R_2O$—$Al_2O_3$ | $3.0 \times 10^4$ | 5 | 21 | 2.6 | 3 | 177 | x | x |
| 67 | Example | 67 | $Fe_2O_3$ + $Fe_3O_4$ + Si oxides + Ni oxides | 74 | $P_2O_5$—ZnO—$R_2O$—$Al_2O_3$ | $7.0 \times 10^3$ | 7 | 22 | 3.1 | 3 | 366 | ○ | ○ |
| 68 | Comparative example | 68 | Not formed | — | $P_2O_5$—ZnO—$R_2O$—$Al_2O_3$ | $3.0 \times 10^4$ | 9 | 23 | 2.6 | 2 | 111 | x | x |
| 69 | Example | 69 | $Fe_2O_3$ + $Fe_3O_4$ + Si oxides + Ni oxides | 75 | $P_2O_5$—ZnO—$R_2O$—$Al_2O_3$ | $5.0 \times 10^5$ | 7 | 24 | 3.4 | 2 | 299 | ○ | ○ |

According to Table 3 and Table 4, in all cases of the soft magnetic metal powder having a crystalline region, the soft magnetic metal powder of amorphous type, and the soft magnetic metal powder of nanocrystal type; by forming a coating part made of a two layer structure having a predetermined composition, even when a heat treatment was carried out at 180° C., the dust core having a sufficient insulation property and a good withstand voltage property can be obtained. Also, when the average crystallite size was within the above mentioned range, it was confirmed that the coercivity before and after forming the second coating part did not increase as much.

On the contrary to this, when the first coating part was not formed, the withstand voltage was low and the insulation property after the heat resistance test decreased, that is it was confirmed that the heat resistance property of the dust core deteriorated. Also, for Experiments 1, 9 11, and 13 of which the first coating part is a natural oxide film, the ratio of trivalent Fe was low and the natural oxide film was not dense, thus the insulation property of the coating part was low as similar to the case of not having the first coating part, and it was confirmed that the withstand voltage and the resistivity of the dust core were extremely low.

Experiments 70 to 101

The soft magnetic metal powder and the dust core were produced as same as Experiments 1 to 69 except that the composition of the powder glass for forming the second coating part was changed to the composition shown in Table 5 to form the second coating part with respect to the soft magnetic metal powder of Sample No. 1, 5, 15, 16, 25, 27, 37, 39, 41, 43, 50, 51, 58, 59, 64, and 65. Also, the produced soft magnetic metal powder and the dust core were subjected to the same evaluation as Experiments 1 to 69. The results are shown in Table 5.

TABLE 5

| Experiment No. | | Soft magnetic metal powder: Soft magnetic metal particle Sample No. | Soft magnetic metal powder: 1st coating part: Oxides | Soft magnetic metal powder: 1st coating part: EELS $Fe^{3+}$ amount (%) | Soft magnetic metal powder: 2nd coating part Coating material | Soft magnetic metal powder: Property Resistivity at 0.6 t/cm$^2$ (Ω · cm) | Dust core: Resin amount (wt %) | Dust core: Property: Withstand voltage (V/mm) | Dust core: Property: Resistivity (Ω · cm): Before heat resistance test | Dust core: Property: Resistivity (Ω · cm): After heat resistance test 180° C. × 1 h |
|---|---|---|---|---|---|---|---|---|---|---|
| 70 | Comparative example | 1 | $FeO + Fe_2O_3 + Fe_3O_4$ | 34 | $Bi_2O_3$—ZnO—$B_2O_3$—$SiO_2$ | $2.0 \times 10^3$ | 4 | 184 | x | x |
| 71 | Comparative example | 1 | $FeO + Fe_2O_3 + Fe_3O_4$ | 34 | BaO—ZnO—$B_2O_3$—$SiO_2$—$Al_2O_3$ | $3.0 \times 10^3$ | 4 | 198 | ○ | x |
| 72 | Example | 5 | $Fe_2O_3 + Fe_3O_4$ | 82 | $Bi_2O_3$—ZnO—$B_2O_3$—$SiO_2$ | $6.0 \times 10^5$ | 4 | 457 | ◎ | ◎ |
| 73 | Example | 5 | $Fe_2O_3 + Fe_3O_4$ | 84 | BaO—ZnO—$B_2O_3$—$SiO_2$—$Al_2O_3$ | $8.0 \times 10^5$ | 4 | 457 | ◎ | ◎ |
| 74 | Comparative example | 15 | Not formed | — | $Bi_2O_3$—ZnO—$B_2O_3$—$SiO_2$ | $2.0 \times 10^2$ | 3 | 183 | x | x |
| 75 | Comparative example | 15 | Not formed | — | BaO—ZnO—$B_2O_3$—$SiO_2$—$Al_2O_3$ | $3.0 \times 10^2$ | 3 | 197 | x | x |
| 76 | Example | 16 | $Fe_2O_3 + Fe_3O_4$ + Ni oxides | 74 | $Bi_2O_3$—ZnO—$B_2O_3$—$SiO_2$ | $6.0 \times 10^5$ | 3 | 321 | ○ | ○ |
| 77 | Example | 16 | $Fe_2O_3 + Fe_3O_4$ + Ni oxides | 75 | BaO—ZnO—$B_2O_3$—$SiO_2$—$Al_2O_3$ | $8.0 \times 10^5$ | 3 | 333 | ○ | ○ |
| 78 | Comparative example | 25 | Not formed | — | $Bi_2O_3$—ZnO—$B_2O_3$—$SiO_2$ | $6.0 \times 10^3$ | 2 | 231 | ○ | x |
| 79 | Comparative example | 25 | Not formed | — | BaO—ZnO—$B_2O_3$—$SiO_2$—$Al_2O_3$ | $7.0 \times 10^3$ | 2 | 256 | ○ | x |
| 80 | Example | 27 | $Fe_2O_3 + Fe_3O_4$ | 75 | $Bi_2O_3$—ZnO—$B_2O_3$—$SiO_2$ | $5.0 \times 10^6$ | 2 | 382 | ◎ | ◎ |
| 81 | Example | 27 | $Fe_2O_3 + Fe_3O_4$ | 83 | BaO—ZnO—$B_2O_3$—$SiO_2$—$Al_2O_3$ | $1.0 \times 10^6$ | 2 | 392 | ◎ | ◎ |
| 82 | Comparative example | 37 | Si oxides | — | $Bi_2O_3$—ZnO—$B_2O_3$—$SiO_2$ | $2.0 \times 10^6$ | 2 | 121 | ◎ | x |
| 83 | Comparative example | 37 | Si oxides | — | BaO—ZnO—$B_2O_3$—$SiO_2$—$Al_2O_3$ | $2.0 \times 10^6$ | 2 | 144 | ◎ | x |
| 84 | Example | 39 | $Fe_2O_3 + Fe_3O_4$ + Si oxides + Cu oxides | 77 | $Bi_2O_3$—ZnO—$B_2O_3$—$SiO_2$ | $3.0 \times 10^6$ | 2 | 321 | ◎ | ◎ |
| 85 | Example | 39 | $Fe_2O_3 + Fe_3O_4$ + Si oxides + Cu oxides | 85 | BaO—ZnO—$B_2O_3$—$SiO_2$—$Al_2O_3$ | $2.0 \times 10^7$ | 2 | 391 | ◎ | ◎ |
| 86 | Comparative example | 41 | Not formed | — | $Bi_2O_3$—ZnO—$B_2O_3$—$SiO_2$ | $3.0 \times 10^5$ | 2 | 165 | ○ | x |
| 87 | Comparative example | 41 | Not formed | — | BaO—ZnO—$B_2O_3$—$SiO_2$—$Al_2O_3$ | $5.0 \times 10^5$ | 2 | 132 | ○ | x |
| 88 | Example | 42 | $Fe_2O_3 + Fe_3O_4$ | 78 | $Bi_2O_3$—ZnO—$B_2O_3$—$SiO_2$ | $3.0 \times 10^6$ | 2 | 368 | ◎ | ◎ |
| 89 | Example | 42 | $Fe_2O_3 + Fe_3O_4$ | 74 | BaO—ZnO—$B_2O_3$—$SiO_2$—$Al_2O_3$ | $4.0 \times 10^6$ | 2 | 402 | ◎ | ◎ |
| 90 | Comparative example | 50 | Not formed | — | $Bi_2O_3$—ZnO—$B_2O_3$—$SiO_2$ | $1.0 \times 10^4$ | 2 | 111 | x | x |
| 91 | Comparative example | 50 | Not formed | — | BaO—ZnO—$B_2O_3$—$SiO_2$—$Al_2O_3$ | $3.0 \times 10^4$ | 2 | 109 | x | x |
| 92 | Example | 51 | $Fe_2O_3 + Fe_3O_4$ + Si oxides + Cr oxides | 74 | $Bi_2O_3$—ZnO—$B_2O_3$—$SiO_2$ | $3.0 \times 10^6$ | 2 | 321 | ○ | ○ |
| 93 | Example | 51 | $Fe_2O_3 + Fe_3O_4$ + Si oxides + Cr oxides | 73 | BaO—ZnO—$B_2O_3$—$SiO_2$—$Al_2O_3$ | $7.0 \times 10^6$ | 2 | 341 | ○ | ○ |
| 94 | Comparative example | 58 | Not formed | — | $Bi_2O_3$—ZnO—$B_2O_3$—$SiO_2$ | $3.0 \times 10^4$ | 2 | 98 | x | x |

TABLE 5-continued

| | | Soft magnetic metal powder | | | | | Dust core | | | |
|---|---|---|---|---|---|---|---|---|---|---|
| | | | | | | | | Property | | |
| | | | 1st coating part | | | | | | Resistivity (Ω · cm) | |
| Experiment No. | | Soft magnetic metal particle Sample No. | Oxides | EELS $Fe^{3+}$ amount (%) | 2nd coating part Coating material | Property Resistivity at 0.6 t/cm$^2$ (Ω · cm) | Resin amount (wt %) | Withstand voltage (V/mm) | Before heat resistance test | After heat resistance test 180° C. × 1 h |
| 95 | Comparative example | 58 | Not formed | — | $BaO—ZnO—B_2O_3—SiO_2—Al_2O_3$ | $1.0 \times 10^4$ | 2 | 88 | x | x |
| 96 | Example | 59 | $Fe_2O_3 + Fe_3O_4$ + Si oxides | 74 | $Bi_2O_3—ZnO—B_2O_3—SiO_2$ | $6.0 \times 10^5$ | 2 | 323 | ○ | ○ |
| 97 | Example | 59 | $Fe_2O_3 + Fe_3O_4$ + Si oxides | 78 | $BaO—ZnO—B_2O_3—SiO_2—Al_2O_3$ | $1.0 \times 10^6$ | 2 | 363 | ○ | ○ |
| 98 | Comparative example | 64 | Not formed | — | $Bi_2O_3—ZnO—B_2O_3—SiO_2$ | $2.0 \times 10^4$ | 3 | 129 | x | x |
| 99 | Comparative example | 64 | Not formed | — | $BaO—ZnO—B_2O_3—SiO_2—Al_2O_3$ | $3.0 \times 10^4$ | 3 | 98 | x | x |
| 100 | Example | 65 | $Fe_2O_3 + Fe_3O_4$ + Si oxides + Al oxides | 78 | $Bi_2O_3—ZnO—B_2O_3—SiO_2$ | $3.0 \times 10^5$ | 3 | 298 | ○ | ○ |
| 101 | Example | 65 | $Fe_2O_3 + Fe_3O_4$ + Si oxides + Al oxides | 79 | $BaO—ZnO—B_2O_3—SiO_2—Al_2O_3$ | $2.0 \times 10^6$ | 3 | 321 | ○ | ○ |

According to Table 5, it was confirmed that even when the composition of the oxide glass constituting the second coating part was changed, the same tendency as Experiments 1 to 69 can be obtained.

Experiments 102 to 136

The resin amount used for producing the dust core was changed as shown in Table 6 with respect to 100 wt % of the soft magnetic metal powder of Experiments 1, 5, 25, 27, 31, and 32, and the dust core was produced and evaluated as similar to each respective Experiments. The results are shown in Table 6.

TABLE 6

| Experiment No. | | Soft magnetic metal powder Experiment No. | Dust core Resin amount (wt %) | Dust core Withstand voltage (V/mm) |
|---|---|---|---|---|
| 102 | Comparative example | 1 | 0.5 | unable to form dust core |
| 103 | Comparative example | 1 | 2 | 53 |
| 104 | Comparative example | 1 | 3 | 134 |
| 105 | Comparative example | 1 | 4 | 284 |
| 106 | Comparative example | 1 | 5 | 321 |
| 107 | Comparative example | 1 | 10 | 783 |
| 108 | Example | 5 | 2 | 156 |
| 109 | Example | 5 | 3 | 258 |
| 110 | Example | 5 | 4 | 569 |
| 111 | Example | 5 | 5 | 734 |
| 112 | Example | 5 | 10 | 1540 |
| 113 | Comparative example | 25 | 0.5 | 98 |
| 114 | Comparative example | 25 | 2 | 243 |
| 115 | Comparative example | 25 | 3 | 321 |
| 116 | Comparative example | 25 | 4 | 342 |
| 117 | Comparative example | 25 | 5 | 367 |
| 118 | Comparative example | 25 | 10 | 581 |
| 119 | Example | 27 | 0.5 | 234 |
| 120 | Example | 27 | 2 | 432 |
| 121 | Example | 27 | 3 | 489 |
| 122 | Example | 27 | 4 | 534 |
| 123 | Example | 27 | 5 | 589 |
| 124 | Example | 27 | 10 | 809 |
| 125 | Comparative example | 31 | 0.5 | 54 |
| 126 | Comparative example | 31 | 2 | 122 |
| 127 | Comparative example | 31 | 3 | 210 |
| 128 | Comparative example | 31 | 4 | 260 |
| 129 | Comparative example | 31 | 5 | 343 |
| 130 | Comparative example | 31 | 10 | 489 |
| 131 | Example | 32 | 0.5 | 153 |
| 132 | Example | 32 | 2 | 258 |
| 133 | Example | 32 | 3 | 365 |
| 134 | Example | 32 | 4 | 432 |
| 135 | Example | 32 | 5 | 545 |
| 136 | Example | 32 | 10 | 832 |

According to Table 6, it was confirmed that the dust core having good withstand voltage can be obtained by forming the first coating part when the amount of resin for producing the dust core was the same.

DESCRIPTION OF THE REFERENCE NUMERAL

1 . . . Coated particle
2 . . . Soft magnetic metal particle
10 . . . Coating part
11 . . . First coating part
12 . . . Second coating part

What is claimed is:

1. A soft magnetic metal powder having soft magnetic metal particles including Fe, wherein a surface of at least one of the soft magnetic metal particles is covered by a coating part, the coating part has a first coating part and a second coating part in this order from the surface of the at least one of the soft magnetic metal particles towards outside, the first coating part covers the surface of the at least one of the soft magnetic metal particles, the first coating part includes an oxide of Fe as a main component, the oxide of Fe included in the first coating part is at least one of $Fe_2O_3$ and $Fe_3O_4$, the first coating part includes an oxide of at least one element selected from the group consisting of Cu, Si, Cr, B, Al, and Ni, the second coating part includes a compound of at least one element selected from the group consisting of P, Si, Bi, and Zn, a ratio of trivalent Fe atom among Fe atoms of the oxide of Fe included in the first coating part is 77% or more, a resistivity of the soft magnetic metal powder when a pressure of 0.6 t/cm$^2$ is applied to the soft magnetic metal powder is $1.0\times10^3$ Ωcm or more, and a coercivity of the soft magnetic metal powder is 321 Oe or less.

2. The soft magnetic metal powder according to claim 1, wherein the second coating part includes the compound of at least one element selected from the group consisting of P, Si, Bi, and Zn as a main component.

3. The soft magnetic metal powder according to claim 1, wherein the at least one of the soft magnetic metal particles includes a crystalline region, and an average crystallite size is 1 nm or more and 50 nm or less.

4. The soft magnetic metal powder according to claim 1, wherein the at least one of the soft magnetic metal particles is amorphous.

5. A dust core constituted by the soft magnetic metal powder according to claim 1.

6. A magnetic component comprising the dust core according to claim 5.

7. The soft magnetic metal powder according to claim 1, wherein the second coating part includes an oxide glass of at least one element selected from the group consisting of P, Si, Bi, and Zn.

8. The soft magnetic metal powder according to claim 1, wherein the coercivity of the soft magnetic metal powder is 28 Oe or less.

9. The soft magnetic metal powder according to claim 1, wherein the thickness of the first coating part is 3 nm or more and 20 nm or less.

* * * * *